US011438996B2

(12) United States Patent
Tuohimaa et al.

(10) Patent No.: US 11,438,996 B2
(45) Date of Patent: Sep. 6, 2022

(54) METHOD FOR PROTECTING AN X-RAY SOURCE AND AN X-RAY SOURCE

(71) Applicant: Excillum AB, Kista (SE)

(72) Inventors: Tomi Tuohimaa, Kista (SE); Per Takman, Kista (SE); Daniel Larsson, Kista (SE)

(73) Assignee: EXCILLUM AB, Kista (SE)

( * ) Notice: Subject to any disclaimer, the term of this patent is extended or adjusted under 35 U.S.C. 154(b) by 234 days.

(21) Appl. No.: 16/967,151

(22) PCT Filed: Feb. 8, 2019

(86) PCT No.: PCT/EP2019/053151
§ 371 (c)(1),
(2) Date: Aug. 4, 2020

(87) PCT Pub. No.: WO2019/154994
PCT Pub. Date: Aug. 15, 2019

(65) Prior Publication Data

US 2020/0367351 A1 Nov. 19, 2020

(30) Foreign Application Priority Data

Feb. 9, 2018 (EP) ..... 18156151

(51) Int. Cl.
*H05G 2/00* (2006.01)
*H05G 1/54* (2006.01)

(52) U.S. Cl.
CPC ..... *H05G 2/003* (2013.01); *H05G 1/54* (2013.01); *H05G 2/008* (2013.01)

(58) Field of Classification Search
CPC ..... H05G 2/00; H05G 2/003; H05G 2/008; H05G 1/54; H01J 13/00; H01J 35/116; H01J 2235/082
See application file for complete search history.

(56) References Cited

U.S. PATENT DOCUMENTS

2007/0001130 A1* 1/2007 Bykanov ..... H05G 2/001 250/493.1

FOREIGN PATENT DOCUMENTS

EP 3385976 A1 * 10/2018 ..... H01J 35/116
EP 3385976 A1 10/2018
(Continued)

OTHER PUBLICATIONS

International Preliminary Report on Patentability issued in corresponding International Patent Application No. PCT/EP2019/053151, 13 pages (dated May 15, 2020).
(Continued)

*Primary Examiner* — David E Smith
*Assistant Examiner* — Hsien C Tsai
(74) *Attorney, Agent, or Firm* — Buchanan Ingersoll & Rooney P.C.

(57) ABSTRACT

A method for protecting an X-ray source including: a liquid jet generator configured to form a liquid jet moving along a flow axis; an electron source configured to provide an electron beam interacting with the liquid jet to generate X-ray radiation; the method including: generating the liquid jet: monitoring a quality measure indicating a performance of the liquid jet; identifying, based on the quality measure, a malperformance of the liquid jet; and if said malperformance is identified, causing the X-ray source to enter a safe mode for protecting the X ray source. Further, to corresponding devices.

14 Claims, 5 Drawing Sheets

(56) References Cited

FOREIGN PATENT DOCUMENTS

| | | | |
|---|---|---|---|
| WO | 2010083854 | A1 | 7/2010 |
| WO | 2013185829 | A1 | 12/2013 |

OTHER PUBLICATIONS

International Search Report and Written Opinion issued in corresponding International Patent Application No. PCT/EP2019/053151, 19 pages (dated Jul. 9, 2019).

* cited by examiner

METHOD FOR PROTECTING AN X-RAY SOURCE AND AN X-RAY SOURCE

TECHNICAL FIELD

The inventive concept described herein generally relates to electron impact X-ray sources, and in particular to methods for protecting such X-ray sources.

BACKGROUND

Systems for generating X-rays by irradiating a liquid jet are described in the applicant's International Applications PCT/EP2012/061352 and PCT/EP2009/000481. In these systems, an electron gun comprising a high-voltage cathode is utilized to produce an electron beam that impinges on a liquid jet. The target is preferably formed by a liquid metal with low melting point, such as indium, tin, gallium lead or bismuth, or an alloy thereof, provided inside a vacuum chamber. Means for providing the liquid jet may include a heater and/or cooler, a pressurizing means (such as a mechanical pump or a source of chemically inert propellant gas), a nozzle and a receptacle or a collecting arrangement to collect liquid at the end of the jet. The X-ray radiation generated by the interaction between the electron beam and the liquid jet may leave the vacuum chamber through a window separating the vacuum chamber from the ambient atmosphere.

During operation of the X-ray source, free particles, including debris and vapour from the liquid jet, tend to deposit on the window and the cathode. This causes a gradual degradation of the performance of the system, as depositing debris may obscure the window and reduce the efficiency of the cathode. There is therefore a need for improved X-ray sources having increased useful life as well as increased maintenance intervals.

SUMMARY OF THE INVENTION

It is an object of the present inventive concept to provide an improved X-ray source.

According to a first aspect of the inventive concept, a method for protecting an X-ray source is provided, the X-ray source comprising a liquid jet generator configured to form a liquid jet moving along a flow axis; an electron source configured to provide an electron beam interacting with the liquid jet to generate X-ray radiation; wherein the method comprises: generating the liquid jet; monitoring a quality measure indicating a performance of the liquid jet; comparing the quality measure with a reference measure; identifying, based on the comparison, a malperformance of the liquid jet; and if said malperformance is identified, causing the X-ray source to enter a safe mode for protecting the X ray source.

The liquid target generator may be configured to form a liquid jet propagating through an interaction region, and the electron source may be configured to generate an electron beam directed towards the interaction region, such that the electron beam interacts with the liquid jet in the interaction region to generate X-ray radiation.

The present inventive concept is based on the realization that an X-ray source may be improved by monitoring a quality measure indicating a performance of the liquid jet of the X-ray source. Hereby, if a malperformance is identified based on the quality measure, the X-ray source may be caused to enter a safe mode for protecting the X-ray source. The safe mode may fully prevent or mitigate critical contamination, e.g. liquid metal, created by the malperforming liquid jet, from reaching other parts of the X-ray source, such as an X-ray window, an electron beam tube, an electron beam aperture, a nozzle, and/or a cathode of the X-ray source. Such critical contamination may over a period of time decrease a performance of the X-ray source, or may render the X-ray source inoperable. Further, it is preferable if the malperformance of the liquid jet is identified quickly after the onset of the malperformance, in order to decrease the amount of critical contamination. Preferably, the malperformance is identified before any critical contamination has occurred. The X-ray source may be kept in the safe mode until the malperformance has been corrected, or until the consequences of the malperformance can be avoided or mitigated. In some cases, the X-ray source may continue to operate while in the safe mode, for example if the liquid jet is shielded without interrupting the generation of X-rays in the interaction region. In general, a malperformance of the liquid jet is a state which is preferably avoided, and by causing the X-ray source to enter a safe mode, consequences of the malperformance may be avoided or mitigated.

As is readily understood by the person skilled in the art, some form of contamination caused by the generation of the liquid jet is to be expected when operating an X-ray source under normal operating conditions. However, the contamination referred to in the context of the present disclosure is to be understood as a critical contamination which is caused by a malperformance of the liquid jet. Such critical contamination may severely limit the operation of the X-ray source, and may lead to an unexpected cease of operation of the X-ray source. In the context of the present disclosure, the term 'contamination' will hereinafter refer to such critical contamination. Contamination may include a mist of suspended liquid droplets produced at the exit of the nozzle and/or at a point where the liquid jet impacts liquid contained in the collecting arrangement. Contamination may also include splashes of liquid from the liquid jet. In general, contamination may include debris emanating from the liquid jet which is distributed in the low pressure chamber in the form of vapor, mist and/or splashes. A contaminating effect or contaminating state as referred to in the present disclosure may be defined as an effect or a state of the X-ray source in which contamination of at least part of the X-ray source occurs.

The term 'malperformance' of the liquid jet may, in the context of the present disclosure, be interpreted as an undesired state of the liquid jet, an anomalous condition of the liquid jet, a deviation from a desired performance of the liquid jet, an irregularity of the liquid jet, and/or a state of the liquid jet which may, at some point, cause contamination of at least part of the X-ray source. It is to be understood that a malperformance of the liquid jet need not necessarily be accompanied by a contaminating effect at all times. A malperformance of the liquid jet may in contrast be a pre-state of the liquid jet which if allowed to continue may result in a contaminating state of the liquid jet. It is further to be understood that a malperformance is not limited to infrequent, unusual or rare events. In other words, a malperformance of the liquid jet may be common e.g. during an initial phase of the generation of the liquid jet, wherein the liquid jet is not yet stabilized. Further, a malperformance of the liquid jet may be caused by other parts of the X-ray source, such as e.g. the electron beam and/or the electron source, and in particular by e.g. a calibration of the electron beam and/or a power setting of the electron source. Hence, the liquid jet may be affected by other parts of the X-ray source, and the other parts may give rise to a malperformance of the liquid jet.

The term 'identifying a malperformance of the liquid jet' it is to be understood to include an assumed malperformance of the liquid jet. In other words, it is sufficient if a malperformance of the liquid jet is suspected, for a malperformance of the liquid jet to be identified. Further, a malperformance may be identified by monitoring the quality measure over a period of time and identifying a change of the quality measure during said period of time. The change of the quality measure during said period of time may need to exceed a change threshold for a malperformance to be identified. An advantage with such an arrangement is that absolute values of the quality measure need not necessarily be known. Further, absolute thresholds or intervals of the quality measure need not necessarily be known.

The quality measure, or performance, of the liquid jet may be studied over time so as to establish a nominal trend of the quality measure. Put differently, the quality measure may be observered repeatedly so as to gain knowledge about the development or change of the quality measure over time. The nominal trend may for example be characterised by a series of measurement points lying within a specific range, a series having a certain deviation, or observations representing a relative increase or decrease over time. Hence, the nominal trend may provide the reference from which a deviation in the quality measure may be derived in order to identify a malperformance. It is appreciated that the monitored quality measure may be compared with a nominal trend that is established dynamically during the operation, or with a nominal trend that has been established at a prior occasion and stored for later reference.

The nominal trend may also be characterised by a threshold, defining the upper and/or lower limit for the series of observed quality measures. A malperformance may be identified if the difference between an observed quality measure and the reference measure exceeds the threshold value. The threshold may be based on an observed variation of the quality measure, e.g. the threshold may set at two standard deviations of the series of observed quality measures.

The reference measure may be obtained via a direct measurement of the quality measure under known circumstances, e.g. during production, set-up, calibration or operation of the X-ray source. The reference measure may also be determined without a direct measurement performed with the particular X-ray source, e.g. a measurement made with another source or an average of measurements performed for a number of X-ray sources may be used. The reference measure may be established independently of any particular measurements by performing a theoretical calculation.

The term 'liquid jet' may, in the context of the present application, refer to a stream or flow of liquid being ejected through e.g. a nozzle and propagating through a system for generating X-rays. Even though the liquid jet in general may be formed of an essentially continuous flow or stream of liquid, it will be appreciated that the liquid jet additionally, or alternatively, may comprise or even be formed of a plurality of droplets. In particular, droplets may be generated upon interaction with the electron beam. Such examples of groups or clusters of droplets may also be encompassed by the term 'liquid jet'.

Typically, the liquid target material is a metal which preferably has a relatively low melting point. Examples of such metals include indium, gallium, tin, lead, bismuth and alloys thereof.

The quality measure referred to in the present disclosure will now be discussed in more detail. It is to be understood that a combination of quality measures may be monitored, in other words at least one quality measure indicating the performance of the liquid jet may be monitored. In some cases, a quality measure threshold or interval may be referred to. Such a quality measure threshold or interval may be pre-determined and/or adaptive. By adaptive threshold or interval, it is implied that the threshold or interval may be altered during the course of operation of the X-ray source. An advantage with such a threshold or interval may be that the X-ray source is less sensitive to minor malperformances and/or disturbances. Another advantage with an adaptive threshold or interval may be a reduced need for calibration or adjustment of the means used for monitoring a quality measure.

As will be understood from the present disclosure, while the quality measure does indicate a performance of the liquid jet, it need not necessarily be monitored directly via the liquid jet. The performance of the liquid jet may in contrast be indicated by the quality measure by e.g. a monitoring arrangement collecting data from various parts of the X-ray source, such as e.g. the collecting arrangement, the liquid jet generator, the electron source, and/or the pressure chamber.

Further, it is to be understood that when referring to a quality measure being associated with a physical property or quantity, such as e.g. shape, speed, and pressure, it follows that said quality measure may be the physical property or quantity as such, and/or that said quality measure may be indirectly associated with the physical property or quantity.

The quality measure may be associated with a shape of the liquid jet. The shape of the liquid jet may refer to a shape along the flow axis, and/or a shape of a transverse cross-section of the liquid jet. In some cases, it may be preferable if the liquid jet has a uniform and/or symmetrical shape along the flow axis. Consequently, the quality measure may be associated with the shape of the liquid jet, and in particular a regularity of the shape of the liquid jet along the flow axis. In this regard, there may exist a shape threshold or shape interval, and a malperformance of the liquid jet may be identified if the shape threshold is exceeded, or if the quality measure falls outside the shape interval. Such a threshold or interval may for example reflect a magnitude of a shape irregularity and/or a frequency of shape irregularities.

The quality measure may be associated with a width of the liquid jet. Similarly to the shape of the liquid jet, the width of the liquid jet may preferably be uniform along the flow axis. Consequently, the quality measure may be associated with the width of the liquid jet, and in particular a regularity of the width of the liquid jet along the flow axis. In this regard, there may exist a first width threshold or first width interval, and a malperformance of the liquid jet may be identified if the first width threshold is exceeded, or if the quality measure falls outside the first width interval. Alternatively, the width of the liquid jet is observed in a plurality of measurements to establish a nominal trend for the width. The nominal trend may for example represent an increasing or reducing width over time, for example in connection with startup of the system. In one example, the width of the liquid jet may describe a continuously growing trend for a certain period of time, and a devitation from such a trend, during such a period of time, be identified as a malperformance.

In particular, it may be advantageous to monitor the width of the liquid jet along a portion of the liquid jet. In this regard, there may exist a second width threshold or interval pertaining to the length of the portion along the flow axis. Hereby, a malperformance of the liquid jet may be identified if both the first width threshold and the second width threshold are exceeded, or if the quality measure falls outside both the first width interval and the second width interval.

The quality measure may be associated with a speed of the liquid jet along the flow axis. For example, it may be preferable if the speed of the liquid jet along the flow axis is within a speed threshold or speed interval. If the speed of the liquid jet along the flow axis exceeds the speed threshold or if the quality measure falls outside the speed interval, a malperformance of the liquid jet may be identified. In other words, a malperformance of the liquid jet may be identified if the quality measure, associated with the speed of the liquid jet along the flow axis, passes an upper speed threshold, and/or passes a lower speed threshold, and/or falls outside the speed interval. Similar to the width example above, variations in speed may be observed over time so as to establish a nominal trend. The trend may be associated with specific operating conditions of the X-ray source, related to e.g. a startup procedure, maintenance, operating temperature etc.

The quality measure may be associated with a pressure within the liquid jet generator. The liquid jet generator may be defined as a space wherein liquid metal is held before being ejected through a nozzle of the liquid jet generator in order to form the liquid jet. The space where the liquid metal is held may include paths connecting the liquid jet generator to a collecting arrangement arranged to collect the liquid jet after it has been ejected from the nozzle. In other words, the liquid jet generator may be in liquid communication with the collecting arrangement, and the liquid jet generator may comprise a path configured to allow liquid, e.g. liquid metal, to be transferred from the collecting arrangement to the liquid jet generator. The path may hereafter be referred to as a recirculating path. It may be preferable if the pressure within the liquid jet generator is below or within a pressure threshold or pressure interval. If the pressure within the liquid jet generator exceeds the pressure threshold, or if the quality measure falls outside the pressure interval, a malperformance of the liquid jet may be identified.

The pressure within the liquid jet generator may indicate if the nozzle is performing adequately. For example, if the nozzle is partially clogged, the pressure within the liquid jet generator may increase above a threshold value. A partially clogged nozzle may affect the performance of the liquid jet, and may in some cases cause a malperformance of the liquid jet. Therefore, a pressure exceeding the threshold value may be identified as a malperformance and result in the X-ray source entering safe mode. Similarly, the pressure within the liquid jet generator may indicate if a filter of the liquid jet generator is performing adequately. Such a filter may be arranged in conjunction with the nozzle of the liquid jet generator in order to remove particulate contaminants from the liquid metal before they reach the nozzle. A further embodiment may include a separate filter path used for removing solid contaminants from the liquid. The filter path may be employed as a part of regular maintenance. The filter path may also be employed as a part of the safe mode entered if a malperformance is identified. The filter path may be employed by switching of two valves controlling the flow of liquid so as to pass through the filter path and back to the ordinary path without passing through the nozzle. In this way contaminants may be removed from the liquid without risk of clogging the nozzle.

The quality measure may be associated with a movement of the liquid jet perpendicular to the flow axis. In this regard, it may be noted that either or both of an amplitude and a frequency of movement of the liquid jet perpendicular to the flow axis may be of interest. The amplitude of movement of the liquid jet perpendicular to the flow axis may be reflected in the quality measure by a movement amplitude threshold or movement amplitude interval. In other words, if the movement of the liquid jet perpendicular to the flow axis exceeds the movement amplitude threshold, or if the quality measure falls outside the movement amplitude interval, a malperformance of the liquid jet may be identified. Similarly, a frequency of movement of the liquid jet perpendicular to the flow axis may be reflected in the quality measure by a movement frequency threshold or movement frequency interval. The movement frequency threshold or movement frequency interval may be combined with the movement amplitude threshold or movement amplitude interval. In other words, if the movement of the liquid jet perpendicular to the liquid jet exceeds the movement amplitude threshold, or if the quality measure falls outside the movement amplitude interval, but does not do this more than a set number of times during a set time period, the movement frequency threshold may not be exceeded and/or the quality measure may be kept within the movement frequency interval, and a malperformance may thus not be identified.

The monitoring arrangement referred to in the present disclosure will now be discussed in more detail The quality measure may be monitored via a monitoring arrangement comprising at least one of an acoustic sensor, an accelerometer, an optic sensor, an electron detector, an x ray detector, and an inductive coil arrangement.

In general, it may be preferable if the monitoring arrangement is configured to monitor the quality measure over time, and/or if the quality measure is monitored as a difference between at least two sensor readings. The at least two sensor readings may originate from at least two sensors of the same type, e.g. at least two accelerometers, at least two acoustic sensors, at least two inductive coil arrangements etc. In one example, a first accelerometer is arranged such that it is expected to be affected by a malperformance of the liquid jet, and a second accelerometer is arranged such that it is not expected to be affected by a malperformance of the liquid jet. Hereby, an arrangement which is less susceptible to background noise caused by e.g. fans, pumps, and/or the outside environment may be achieved.

In particular, the acoustic sensor may be configured to detect acoustic emissions created by the liquid jet, and/or created by the interaction between the liquid jet and other parts of the X-ray source. For example, a malperformance of the liquid jet may be identified if a characteristic sound pattern is detected by the acoustic sensor, and/or if an acoustic pressure exceeding an acoustic pressure threshold is detected. The acoustic sensor may be arranged to be in contact with a surface of the X-ray source, such that acoustic vibrations may reach the acoustic sensor via propagation through the surface of the X-ray source. The acoustic sensor may also be arranged outside of the low pressure chamber.

The accelerometer may function similarly to the acoustic sensor, and the accelerometer may be configured to detect vibrations created by the liquid jet. A malperformance of the liquid jet may be identified if a vibration threshold is exceeded, and/or if a characteristic vibration pattern is detected.

The optic sensor may be configured to retrieve an image of the liquid jet. Hereby, e.g. a shape, width, speed and/or movement of the liquid jet may be determined. The optic sensor may be a non-imaging optic sensor. The optic sensor may be configured to detect electromagnetic radiation which has interacted with the liquid jet. Such an interaction comprise scattering, transmission, reflection etc. A radiation emitting arrangement may be arranged in the low pressure chamber to provide electromagnetic radiation. The light emitting arrangement may be e.g. a laser generating arrangement or a radioactive source. A radiation emitting material may be comprised within the liquid jet.

The X-ray detector may be configured to detect X-rays generated by the interaction of the electron beam and the liquid jet. By analyzing the characteristics of such X-rays, the performance of the liquid jet may indirectly be deduced. For example, if the width of the liquid jet decreases such that less electrons interact with the liquid jet, the flux and/or intensity of the generated X-rays may be decreased. Furthermore, if the shape of the liquid jet deviates from a nominal circular shape the width of the projected X-ray spot may change, thus by monitoring the size of the X-ray spot a measure on jet stability may be obtained.

The electron detector may be arranged behind the interaction region as seen from the electron source. The electron detector may be configured to detect electrons which has not interacted with the liquid jet, but instead has passed e.g. on aside, or through a gap, of the liquid jet. Hereby, a shape, width and/or movement of the liquid jet may be determined. The monitoring arrangement may also comprise an electron detector configured to detect electrons scattered from the jet, a process that may be referred to as electron backscatter. The amount of electrons scattered in a particular direction depends on jet surface, thus if a jet malperformance cause a change of the liquid jet, such as a change of the surface or shape of the liquid jet, this may be registered as a change in amount of scattered electrons.

The inductive coil arrangement may comprise a transmitter coil and a receiver coil configured to utilize the liquid jet as an inductive coupling between the transmitter coil and the receiver coil, wherein the transmitter coil is configured to pass a current through the transmitter coil and wherein the receiver coil is configured to receive an induced current.

In one arrangement, the transmitter coil and receiver coil are displaced along the flow axis with respect to each other. Such an arrangement may be capable of detecting a change of shape and/or width of the liquid jet.

In one arrangement, at least one pair of a transmitter coil and a receiver coil is arranged in substantially one transverse plane with respect to the flow axis. The transmitter coil and receiver coil are preferably arranged on opposite sides of the liquid jet. Such an arrangement may be capable of detecting a movement of the liquid jet perpendicular to the flow axis.

It may be preferable to arrange a first and a second pair, each pair comprising a transmitter coil and a receiver coil arranged in substantially one respective transverse plane with respect to the flow axis. The respective transverse planes may be one and the same transverse plane. The first pair may be arranged along a first axis, and the second pair may be arranged along a second axis being substantially perpendicular to the first axis. Such an arrangement may be capable of detecting a movement of the liquid jet in any direction being perpendicular to the flow axis.

A further arrangement comprises one transmitter coil and a plurality of receiver coils arranged around the liquid jet. Changes in shape, width, and/or position of the liquid jet may be detected by monitoring the relative signal strengths in the receiver coils.

Further, the sensitivity of the inductive coil arrangement may be improved by the use of a lock-in amplifier. In such an arrangement, the transmitting coil may be supplied with an alternating current of a pre-determined frequency. The receiver coil will in this case receive an induced current of the same pre-determined frequency. A lock-in amplifier may consequently be connected to the inductive coil arrangement, wherein the lock-in amplifier is configured to amplify the signal, e.g. the induced current, with the pre-determined frequency. Hereby, a signal-to-noise ratio may be improved.

Entering the safe mode may comprise at least one of: reducing a speed of the liquid jet along the flow axis; reducing a power output of the electron source; terminating generation of the liquid jet; shielding at least part of the X-ray source from contamination created by the malperformance of the liquid jet; and changing a filter of the liquid jet generator. An embodiment of the method may comprise terminating generation of the liquid jet and prompting an operator to exchange filter and/or nozzle. Preferably, the exchange is performed without venting the low pressure chamber. A valve may be closed prior to removing the old nozzle and/or filter. The exchange operation may introduce air into the system. Preferably this air is evacuated before opening the valve towards the vacuum chamber. A further embodiment may comprise automatizing the exchange operation by providing a filter exchange tool.

An embodiment may comprise deploying a shield around the jet path during startup of the jet generator. The shield may be removed after a certain amount of time or when the monitored quality measure is within a certain range or has passed a certain threshold.

According to a second aspect of the inventive concept, an X-ray source is provided comprising: a liquid jet generator configured to form a liquid jet moving along a flow axis; an electron source configured to provide an electron beam interacting with the liquid jet to generate X-ray radiation; a monitoring arrangement configured to monitor a quality measure indicating a performance of the liquid jet; and a processing unit configured to identify, based on the quality measure, a malperformance of the liquid jet; wherein the X-ray source is configured to enter a safe mode for protecting the X-ray source if said malperformance is identified.

It may be noted that the processing unit need not necessarily be arranged in the X-ray source. In contrast, the processing unit may be an external processing unit communicatively coupled to the X-ray source, thus giving the X-ray source processing capabilities via the communicative connection. The processing unit may also be a cloud processing unit communicatively connected to the X-ray source, thus giving the X-ray source processing capabilities via the communicative connection.

The monitoring arrangement may comprise an acoustic sensor configured to detect acoustic emissions created by the liquid jet, and/or the generation of the liquid jet.

The monitoring arrangement may comprise an accelerometer configured to detect vibrations created by the liquid jet, and/or by the generation of the liquid jet.

The monitoring arrangement may comprise an optic sensor. The optic sensor may be configured to monitor the liquid jet, the collecting arrangement, the nozzle, and/or any other part of the X-ray source which may indicate a performance of the liquid jet.

The monitoring arrangement may comprise an electron detector configured to receive at least part of the electron beam passing the liquid jet or at least part of the electrons scattered from the liquid jet.

The monitoring arrangement may comprise an X-ray detector configured to detect X-rays generated by an interaction between the electron beam and the liquid jet.

The monitoring arrangement may comprise an inductive coil arrangement comprising a transmitter coil and a receiver coil configured to utilize the liquid jet as an inductive coupling between the transmitter coil and the receiver coil, wherein the transmitter coil is configured to pass a current and wherein the receiver coil is configured to receive an induced current.

The monitoring arrangement may comprise a pressure sensor configured to detect a pressure within the liquid jet generator.

The quality measure may be associated with at least one of a shape of the liquid jet, a width of the liquid jet, a speed of the liquid jet, a pressure in the liquid jet generator, and a movement of the liquid jet with respect to the flow axis.

The X-ray source may further comprise a shield arrangement, and wherein the processing unit is configured to, when the X-ray source is in the safe mode, position the shield arrangement such that at least part of the X-ray source is shielded from contamination created by the malperformance of the liquid jet. The shield arrangement may be one or more protective plates or screens that may be arranged in the vicinity of the liquid jet. In particular, the shield arrangement may be configured to at least partially enclose the liquid jet.

It is also envisioned that the shield arrangement may be configured to at least partially shield individual parts of the X-ray source, such as e.g. the electron source, the X-ray window, the collecting arrangement and/or any part of the monitoring arrangement. In such an arrangement, it may be preferable if the shield arrangement is arranged in the vicinity of each of the respective parts to be shielded.

The shield arrangement may be understood as a means or tool capable of capturing contaminants, such as e.g. a particle trap, a surface onto which particles may be adsorbed or deposited, and/or an ion trap.

The shield arrangement may also comprise an aperture arranged to allow the liquid jet to pass through the aperture. In such an arrangement, the shield arrangement may be configured to receive contamination on a downstream side of the shield arrangement.

The processing unit may be configured to, when the X-ray source is in the safe mode, terminate a generation of the liquid jet.

The X ray source may further comprise a filter exchange tool, and wherein the processing unit is configured to, when the X-ray source is in the safe mode, operate the filter exchange tool in order to change a filter of the liquid jet generator.

The processing unit may be configured to, when the X-ray source is in the safe mode, reduce a speed of the liquid jet along the flow axis.

The processing unit may be configured to, when the X-ray source is in the safe mode, reduce a power output of the electron source.

An X-ray source according to the inventive concept may further comprise a collecting arrangement for collecting the liquid jet at an end of the liquid jet. It may be desirable to recover the e.g. liquid metal of the liquid jet in order to allow a continuous operation of the X-ray source. Thus, the collecting arrangement may be in liquid communication with the liquid jet generator. The liquid jet generator may preferably comprise a pressurizing arrangement configured to force the liquid metal out of a nozzle of the liquid jet generator, and a heater and/or cooler. Further, the X-ray source may comprise an X-ray window having suitable transmission characteristics to allow X-rays generated via interaction of the electron beam and the liquid jet to exit a low pressure chamber of the X-ray source in which the liquid jet generator, the electron source, and an interaction region is provided.

By way of example, the operation of the X-ray source, in particular with respect to generation of the liquid jet, is described below:

The pressure of liquid contained in a first portion of the recirculating path is raised to at least 10 bar, preferably at least 50 bar or more, using a high-pressure pump.

The pressurized liquid is conducted to a nozzle, although any conduction through a conduit will entail some, possibly negligible under the circumstances, loss of pressure, the pressurized liquid reaches the nozzle at a pressure still above 10 bar, preferably above 50 bar.

The liquid is ejected from the nozzle into a vacuum chamber or low pressure chamber, in which the interaction region is located, for generating a liquid jet.

The ejected liquid is collected in a collecting arrangement after passage through the interaction region.

The pressure of the collected liquid is raised to a suction side pressure (inlet pressure) for the high-pressure pump, in a second portion of the recirculating path located between the collecting arrangement and the high-pressure pump in the flow direction (i.e. during normal operation of the system, liquid flows from the collecting arrangement towards the high-pressure pump). The inlet pressure for the high-pressure pump is at least 0.1 bar, preferably at least 0.2 bar, in order to provide reliable and stable operation of the high-pressure pump.

The steps are typically repeated continuously. In other words, the liquid at the inlet pressure is again fed to the high-pressure pump which again pressurizes the liquid to at least 10 bar, so that the supply and generation of a liquid jet to the interaction region is effected in a continuous fashion. Other objectives, features and advantages of the present inventive concept will appear from the following detailed disclosure, from the attached claims as well as from the drawings. A feature described in relation to one aspect may also be incorporated in other aspects, and the advantage of the feature is applicable to all aspects in which it is incorporated.

Generally, all terms used in the claims are to be interpreted according to their ordinary meaning in the technical field, unless explicitly defined otherwise herein. Further, the use of terms "first", "second", and "third", and the like, herein do not denote any order, quantity, or importance, but rather are used to distinguish one element from another. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present inventive concept, will be better understood through the following illustrative and non-limiting detailed description of different embodiments of the present inventive concept, with reference to the appended drawings, wherein.

Figure 6A:
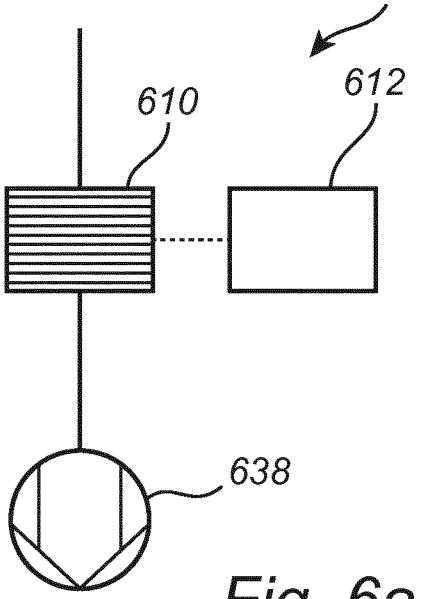
Figure 6B:
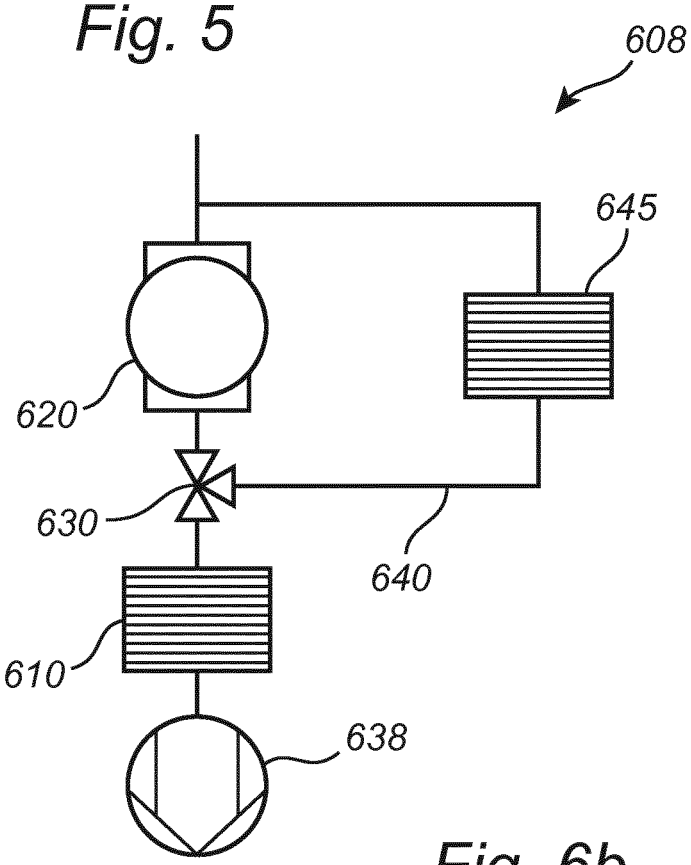

The figures are not necessarily to scale, and generally only show parts that are necessary in order to elucidate the inventive concept, wherein other parts may be omitted or merely suggested;

FIGS. 6*a*-6*b* schematically illustrate a filter and a filter exchange tool.

DETAILED DESCRIPTION

An X-ray source 100 according to the inventive concept will now be described with reference to FIG. 1.

Figure 1:
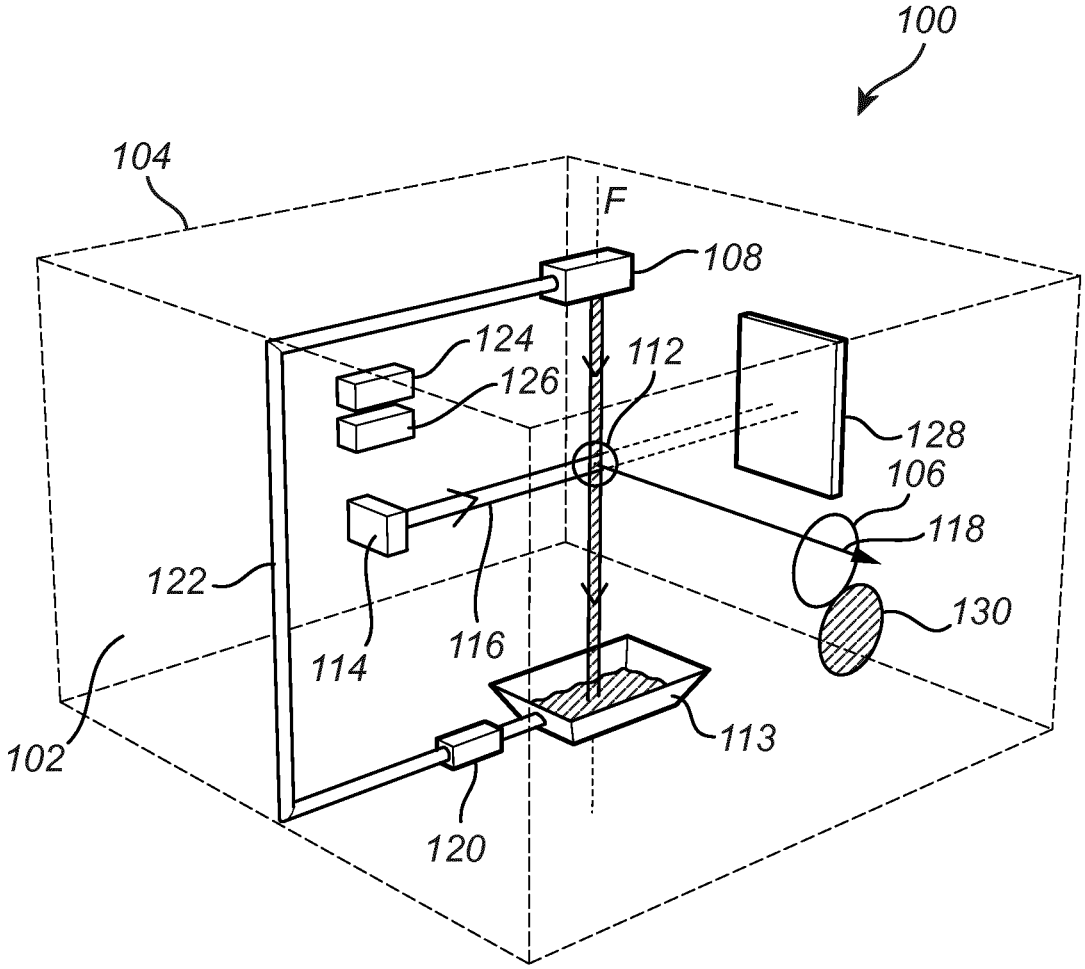
FIG. 1 schematically illustrates an X-ray source in a perspective view.

As indicated in FIG. 1, a low pressure chamber, or vacuum chamber, 102 may be defined by an enclosure 104 and an X-ray transparent window 106 which separates the low pressure chamber 102 from the ambient atmosphere. The X-ray source 100 comprises a liquid jet generator 108 configured to form a liquid jet 110 moving along a flow axis F. The liquid jet generator 110 may comprise a nozzle through which liquid, such as e.g. liquid metal may be ejected to form the liquid jet 110 propagating towards and through an interaction region 112. The liquid jet 110 propagates through the interaction region 112, towards a collecting arrangement 113 arranged below the liquid jet generator 108 with respect to the flow direction. The X-ray source 100 further comprises an electron source 114 configured to provide an electron beam 116 directed towards the interaction region 112. The electron source 114 may comprise a cathode for the generation of the electron beam 116. In the interaction region 112, the electron beam 116 interacts with the liquid jet 110 to generate X-ray radiation 118, which is transmitted out of the X-ray source 100 via the X-ray transparent window 106. The X-ray radiation 118 is here directed out of the X-ray source 100 substantially perpendicular to the direction of the electron beam 116.

The liquid forming the liquid jet is collected by the collecting arrangement 113, and is subsequently recirculated by a pump 120 via a recirculating path 122 to the liquid jet generator 108, where the liquid may be reused to continuously generate the liquid jet 110.

A monitoring arrangement 124 is here illustrated as part of the X-ray source 100. It should be noted that the illustration is merely a schematic representation of the inventive concept, and other possible locations of the monitoring arrangement 124 are possible within the scope of the inventive concept. The monitoring arrangement 124 is configured to monitor a quality measure indicating a performance of the liquid jet 110. Further, it is to be understood that the monitoring arrangement may comprise several individual components, such as e.g. at least one of an acoustic sensor, an accelerometer, an optic sensor, an electron detector, an x-ray detector, and an inductive coil arrangement. Such individual components are for the sake of clarity not illustrated in FIG. 1.

A processing unit 126 is here also illustrated as part of the X-ray source 100. Similarly to the monitoring arrangement, the processing unit 126 is here arbitrarily placed in the low pressure chamber 102, and the person skilled in the art appreciates that other possible arrangements of the processing unit 126 are possible within the scope of the inventive concept.

Still referring to FIG. 1, the X-ray source 100 here comprises an electron detector 128 configured to receive at least part of the electron beam 116 passing the liquid jet 110. The electron detector 128 is here arranged behind the interaction region 112 as seen from a viewpoint of the electron source 114. In case the liquid jet 110 moves or changes shape, at least part of the electron beam 116 may pass the liquid jet 110 and interact with the electron detector 128. Thus, the electron detector 128 may monitor a quality measure indicating a performance of the liquid jet 110. It is to be understood that the shape of the electron detector 128 is here merely schematically illustrated, and that other shapes of the electron detector 128 may be possible within the scope of the inventive concept.

Still referring to FIG. 1, the X-ray source may comprise a shield arrangement 130. The shield arrangement 130 is here arranged in conjunction to the X-ray transparent window 106. However, the shield arrangement 130 may also be arranged in conjunction to e.g. the liquid jet 110, the electron source 114, and/or the electron detector 128, as described earlier in the present disclosure. The shield arrangement 130 may be configured to slide and/or move such that the X-ray transparent window 106, and/or other parts of the X-ray source, is shielded from contamination when the X-ray source is in the safe mode.

Figure 2A:
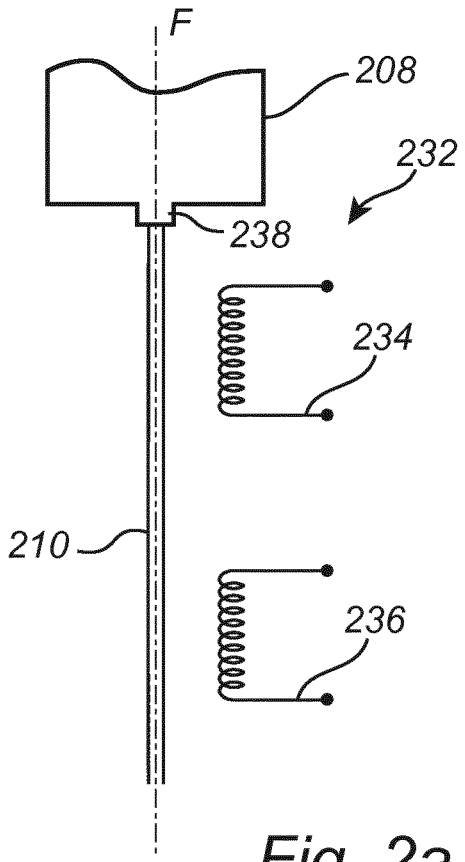
FIGS. 2*a*-2*b* schematically illustrate an example of an inductive coil arrangement in a side view.
Figure 2B:
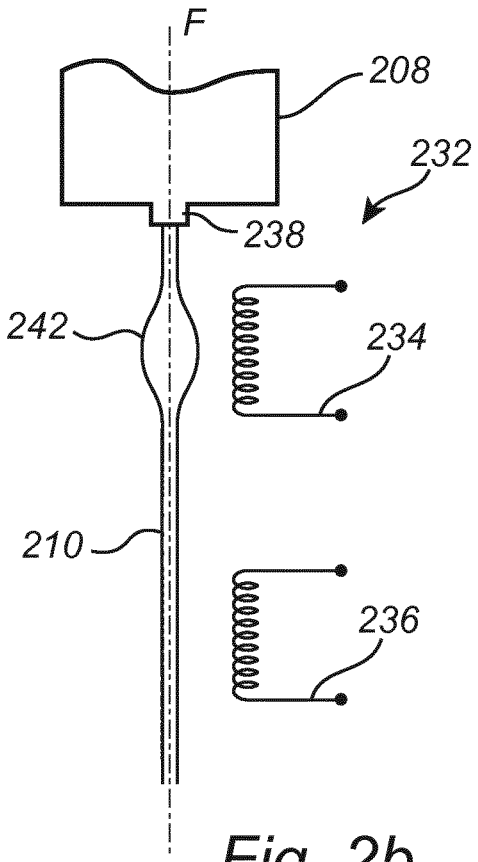

Referring now to FIGS. 2*a*-2*b*, an inductive coil arrangement 232 is illustrated. The inductive coil arrangement 232 comprises a transmitter coil 234 and a receiver coil 236 configured to utilize the liquid jet 210, ejected from a nozzle 238 of a liquid jet generator 208, as an inductive coupling between the transmitter coil 234 and the receiver coil 236. The transmitter coil 234 and receiver coil 236 are here displaced along the flow axis F with respect to each other, with the transmitter coil 234 being arranged upstream of the receiver coil 236. However, the location of the transmitter coil 234 and receiver coil 236 may be interchanged while maintaining the function of the inductive coil arrangement 232. Further, it may also be possible to arrange the transmitter coil 234 and/or the receiver coil 236 such that the liquid jet is enclosed by the coils of the transmitter coil 234 and/or the receiver coil 236.

A current may be passed through the transmitter coil 234, e.g. by means of a current generator such as a DC-generator (not shown). The liquid jet 210 may then act as an inductive coupling, thus inducing a current in the receiver coil 236. The current induced in the receiver coil 236 may be seen as a signal associated with a quality measure of the liquid jet 210. It may also be possible to define a signal associated with a quality measure of the liquid jet 210 as a difference and/or ratio between the current induced in the receiver coil 236, and a current passed through the transmitter coil 234. As can be seen in FIG. 2*a*, the liquid jet 210 has a substantially uniform shape along the flow axis, which may give rise to a first signal in the receiver coil 236. In FIG. 2*b*, a portion 242 of the liquid jet 210 has a larger transverse cross section compared to the liquid jet shown in FIG. 2*a*. Such an enlargement of the transverse cross section of the liquid jet 210 may be seen as a malperformance of the liquid jet 210, and may be caused by a variety of factors pertaining to e.g. the nozzle 238, the liquid jet generator 208, and/or the liquid jet 210. As the liquid jet 210 propagates along the flow axis F, the portion 242 having a deviant transverse cross section passes the transmitter coil 234 and the receiver coil 236, giving rise to a signal in the receiver coil 236, the signal may be utilized in order to determine a quality measure of the liquid jet 210. In the illustrated example, the quality measure may be associated with a shape and/or size of the liquid jet 210.

A possible arrangement of an inductive coil arrangement will now be described with reference to FIGS. 3*a*-3*c*.

Figure 3A:
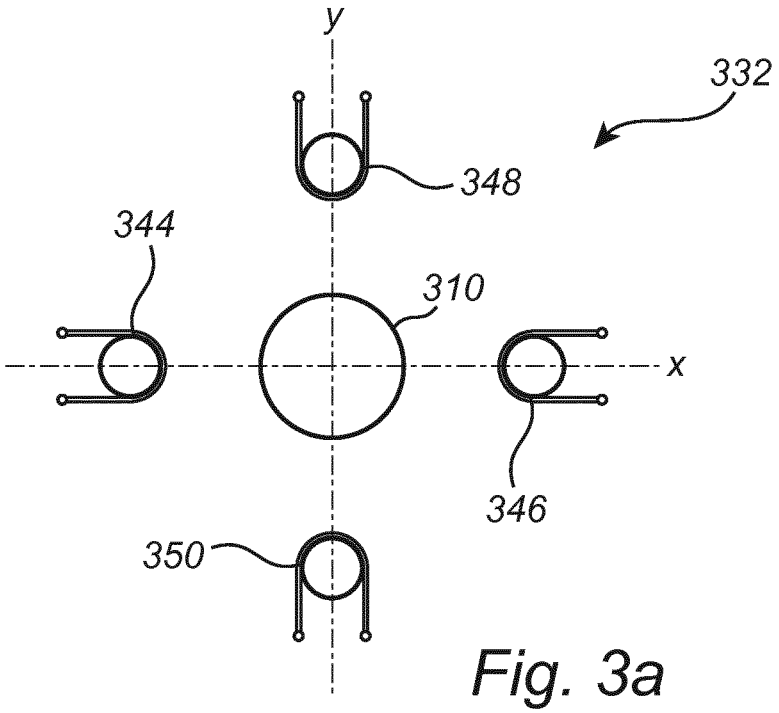
FIG. 3*a*-3*c* schematically illustrate an example of an inductive coil arrangement in a transverse cross-sectional view.

Referring first to FIG. 3*a*, an inductive coil arrangement 332 is illustrated in a transverse cross-sectional view. The inductive coil arrangement 332 comprises a first transmitter coil 344 and a first receiver coil 346 which together form a first pair of coils. The first transmitter coil 344 and the first receiver coil 346 are arranged along one and the same axis, here the x-axis, in the transverse plane on opposite sides of the liquid jet 310. Hereby, the first pair of coils may be capable of detecting a movement of the liquid jet 310 having a vector component along the x-axis. More specifically, a current may be passed through the first transmitter coil 344, and the liquid jet 310 may act as an inductive coupling between the first transmitter coil 344 and the first receiver coil 346, thus inducing a current in the first receiver coil 346. The relative position of the liquid jet 310, and/or the shape of the liquid jet 310 and/or the cross-sectional size of the liquid jet 310, may cause a change of the current induced in the first receiver coil 346.

Still referring to FIG. 3*a*, the inductive coil arrangement 332 may further comprise a second transmitter coil 348 and a second receiver coil 350 which together form a second pair of coils. The second transmitter coil 348 and the second receiver coil 350 arranged along one and the same axis, here the y-axis, in the transverse plane on opposite sides of the liquid jet 310. It may be noted that the second pair of coils are arranged along an axis being substantially perpendicular to the axis along which the first pair of coils are arranged. Hereby, the second pair of coils may be capable of detecting a movement of the liquid jet 310 having a vector component along the y-axis. More specifically, a current may be passed through the second transmitter coil 348, and the liquid jet 310 may act as an inductive coupling between the second transmitter coil 348 and the second receiver coil 350, thus inducing a current in the second receiver coil 348. The relative position of the liquid jet 310, and/or the shape of the liquid jet 310 and/or the cross-sectional size of the liquid jet 310, may cause a change of the current induced in the second receiver coil 350.

The two pair of coils may together form an inductive coil arrangement capable of detecting a movement, and/or change of shape and/or change of size of the liquid jet 310.

Figure 3B:
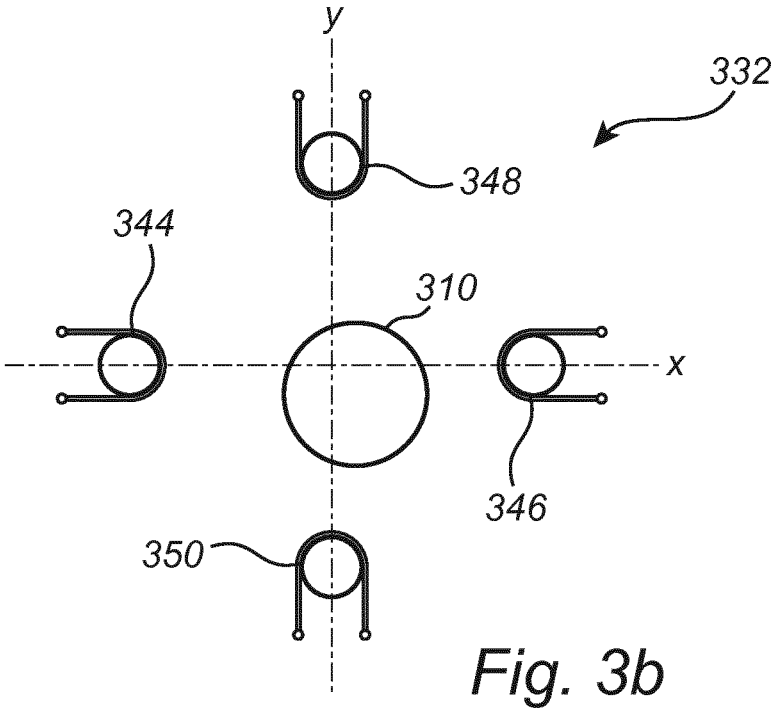

Referring now to FIG. 3*b*, the liquid jet 310 has moved relative the initial position of the liquid jet as illustrated in FIG. 3*a*. Here, the liquid jet 310 has moved in a direction having a vector component along both the x-axis and the y-axis. Consequently, the movement may be detected via the first pair of coils comprising the first transmitter coil 344 and the first receiver coil 346, as well as via the second pair of coils comprising the second transmitter coil 348 and the second receiver coil 350.

Figure 3C:
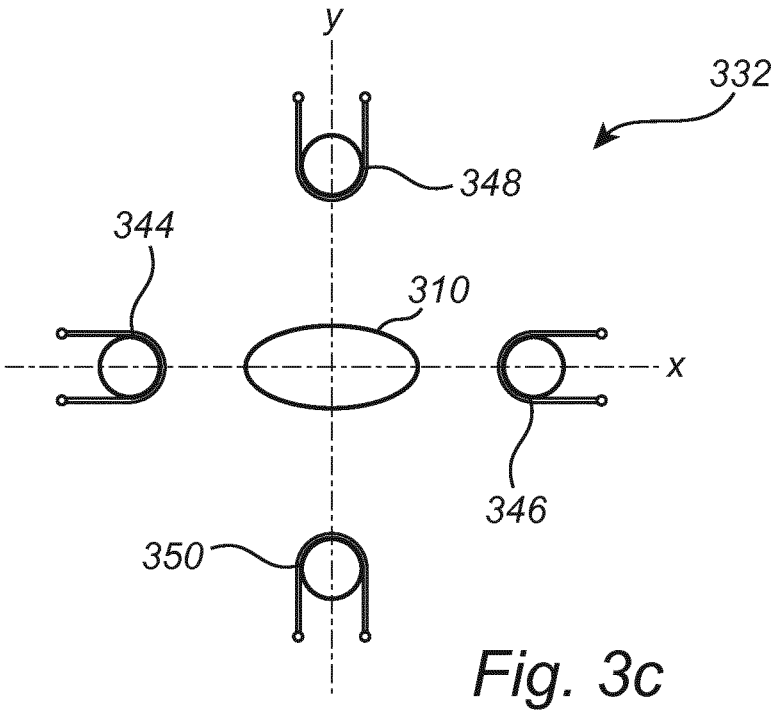

Referring now to FIG. 3*c*, the liquid jet 310 has a different cross-sectional shape and size relative its cross-sectional shape and size as illustrated in FIG. 3*a*. The change of cross-sectional shape and size may be detected via the first pair of coils comprising the first transmitter coil 344 and the first receiver coil 346, as well as via the second pair of coils comprising the second transmitter coil 348 and the second receiver coil 350.

Figure 4C:
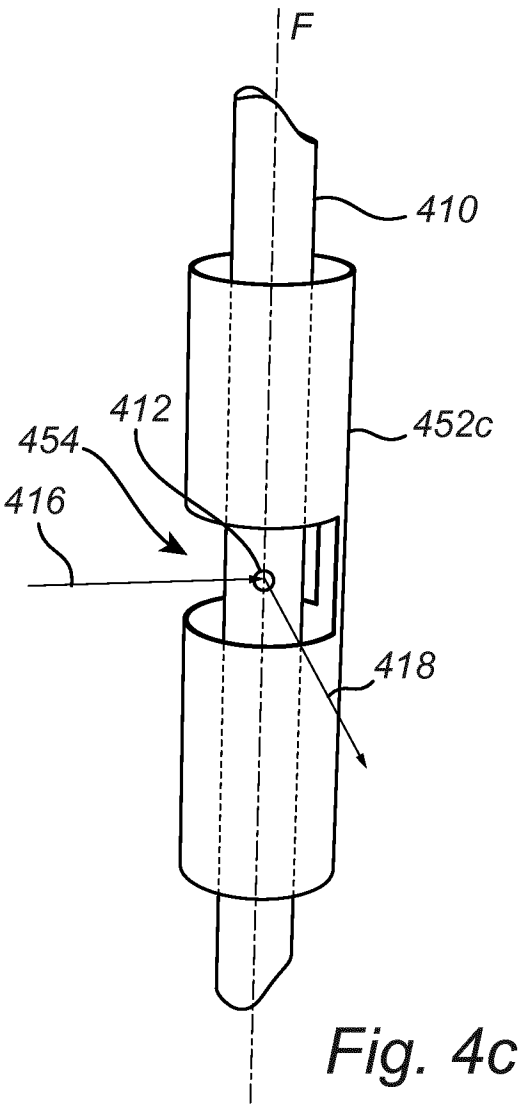
FIGS. 4*a*-4*c* schematically illustrate an example of a shield arrangement in a side view.
Figure 4B:
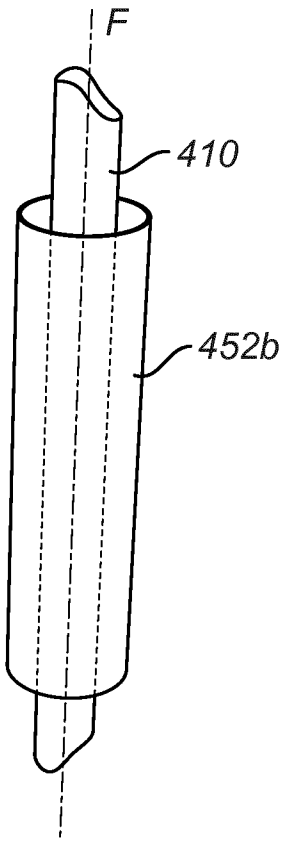
Figure 4A:
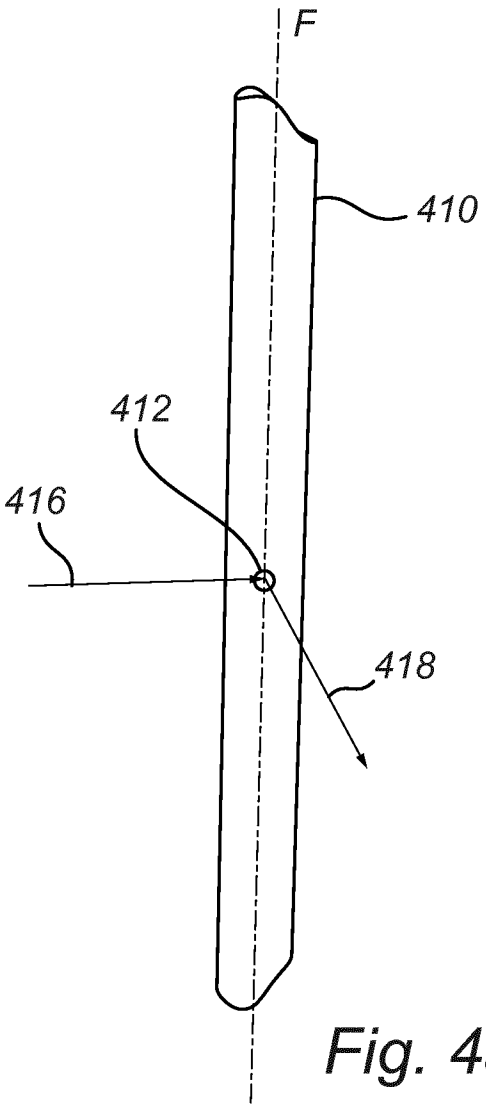

With reference to FIGS. 4*a*-4*c*, a shield arrangement will now be described.

Referring first to FIG. 4*a*, a liquid jet 410 is illustrated during normal operating conditions and performance of an X-ray source. The liquid jet 410 propagates along a flow axis F through an interaction region 412. An electron beam 416, generated by an electron source (not shown), is directed towards the interaction region 412, where the electron beam 416 interacts with the liquid target 410 to generate X-ray radiation.

Referring now to FIG. 4*b*, a malperformance of the liquid jet 410 has been identified, and the X-ray source has been caused to enter a safe mode. A shield arrangement 452*b* has been positioned such that it may capture at least part of any contamination caused by the generation of the liquid jet 410. The shield arrangement 452*b* may be a tube as illustrated, having a diameter being greater than a diameter of the liquid jet 410. The diameter of the tube is preferably chosen to allow movement and enlargement of the liquid jet 410 without allowing contact between the tube and the liquid jet 410. An inner wall of the shield arrangement may comprise a phobic surface thus decreasing the ability for the material in the liquid jet to wet on the inner wall. In the illustrated arrangement, the electron source is preferably caused to cease generation of the electron beam. Consequently, X-ray radiation is no longer generated. The shield arrangement 452*b* may stay deployed until the malperformance of the liquid jet 410 has been corrected.

Referring now to FIG. 4*c*, a malperformance of the liquid jet 410 has been identified, and the X-ray source has been caused to enter a safe mode. A shield arrangement 452*c* has been positioned such that it may capture at least part of any contamination caused by the generation of the liquid jet 410. The shield arrangement 452*c* may be a tube as illustrated, having a diameter being greater than a diameter of the liquid jet 410. The shield arrangement 452*c* comprises an opening 454 allowing the electron beam 416 to interact with the liquid jet 410 in the interaction region 412 in order to generate X-ray radiation 418. Thus, the X-ray source may continue to operate, i.e. generate X-ray radiation, while being in the safe mode.

The shield arrangement may be stored upstream of the nozzle and/or downstream of the collecting arrangement when the X-ray source is not in the safe mode. Upon entering the safe mode, the shield arrangement may be moved into position by sliding the shield arrangement along the flow axis F.

The shield arrangements disclosed in conjunction with FIGS. 4*b*-4*c* are illustrated as tubes. However, it may also be possible to utilize a shield arrangement comprising one or several screens or plates. The one or several screens or plates may be concave in order to form a tube enclosing the liquid jet. Such a shield arrangement may be stored in the low pressure chamber of the X-ray source, and upon entering the safe mode, the one or several screens or plates may be moved into position to shield at least part of the X-ray source from contamination caused by the generation of the liquid jet. An advantage with such an arrangement is that the one or several screens or plates may be moved into position in a direction being substantially perpendicular to the flow axis F.

Figure 5:
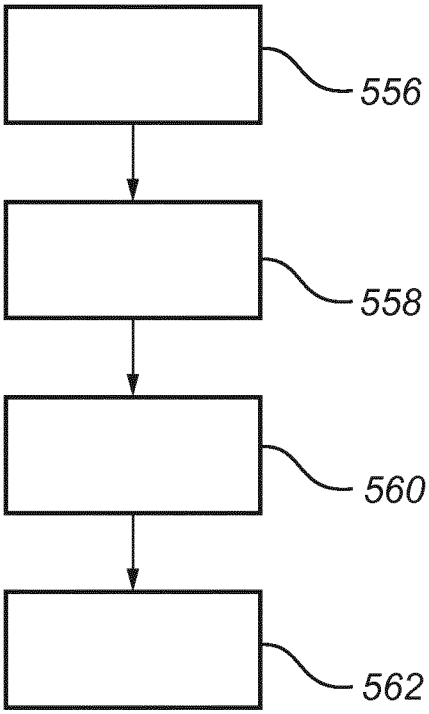
FIG. 5 is a flow chart diagram of a method for protecting an X-ray source.

A method for protecting an X-ray source will now be described with reference to FIG. 5. For clarity and simplicity, the method will be described in terms of 'steps'. It is emphasized that steps are not necessarily processes that are delimited in time or separate from each other, and more than one 'step' may be performed at the same time in a parallel fashion.

The X-ray source comprises a liquid jet generator configured to form a liquid jet moving along a flow axis; and an electron source configured to provide an electron beam interacting with the liquid jet to generate X-ray radiation. In step 556, a liquid jet is generated. In step 558, a quality measure indicating a performance of the liquid jet is monitored. In step 560, a malperformance of the liquid jet is identified based on the quality measure. In step 562 the X-ray source is caused to enter a safe mode for protecting the X-ray source, if said malperformance is identified.

Referring now to FIG. 6*a*, a liquid jet generator 608 is schematically illustrated in a process flow diagram. Liquid metal here pass a filter 610 arranged in conjunction with a nozzle 638. The filter 610 may be configured to remove particulate contaminants from the liquid metal, such that particulate contaminants are removed before the liquid metal reach the nozzle 638. Hence, the filter 610 is arranged upstream of the nozzle 638. A filter exchange tool 612 may be arranged in conjunction with the filter 610. The filter exchange tool 612 may be operated in order to, automatically, change the filter 610 of the liquid jet generator 608.

Referring now to FIG. 6*b*, another example of a liquid jet generator 608 is schematically illustrated in a process flow diagram. Liquid metal may here be redirected into a filter by-pass path 640 via a three-way valve 630. A filter 645 configured to remove particulate contaminants from the liquid metal is arranged in the filter by-pass path 640. During normal operation the three-way valve 630 directs liquid metal pumped from a pump 620 towards the filter 610 and nozzle 638. However, when entering a safe mode, or as a part of maintenece procedures, the valve directs the liquid metal into the filter by-pass path 640 where it flows through filter 645 back to an inlet port of pump 620. Liquid metal may thus pass the filter 645 several times before being re-directed to the nozzle 638 via three-way valve 630. In this way an excess of particulate matter that might have formed e.g. during an episode of increased pressure within the vacuum chamber may be removed from the liquid metal without risk of clogging the filter 610 or the nozzle 638. A filter exchange tool (not shown) may be operated in order to, automatically, change the filter 610 and/or the filter 645 of the liquid jet generator 608.

The person skilled in the art by no means is limited to the example embodiments described above. On the contrary, many modifications and variations are possible within the scope of the appended claims. In particular, X-ray sources and systems comprising more than one liquid jet or more than one electron beam are conceivable within the scope of the present inventive concept. Furthermore, X-ray sources of the type described herein may advantageously be combined with X-ray optics and/or detectors tailored to specific applications exemplified by but not limited to medical diagnosis, non-destructive testing, lithography, crystal analysis, microscopy, materials science, microscopy surface physics, protein structure determination by X-ray diffraction, X-ray photo spectroscopy (XPS), critical dimension small angle X-ray scattering (CD-SAXS), and X-ray fluorescence (XRF). Additionally, variation to the disclosed examples can be understood and effected by the skilled person in practising the claimed invention, from a study of the drawings, the disclosure, and the appended claims. The mere fact that certain measures are recited in mutually different dependent claims does not indicate that a combination of these measures cannot be used to advantage.

LIST OF REFERENCE SIGNS

100 X-ray source
102 Low pressure chamber
104 Enclosure
106 X-ray transparent window
108 Liquid jet generator
110 Liquid jet
112 Interaction region
114 Electron source
116 Electron beam
118 X-ray radiation
120 Pump
122 Recirculating path
124 Monitoring arrangement
126 Processing unit
128 Electron detector
130 Shield arrangement
208 Liquid jet generator
210 Liquid jet
232 Inductive coil arrangement
234 Transmitter coil
236 Receiver coil
238 Nozzle
332 Inductive coil arrangement
344 First transmitter coil
346 First receiving coil
348 Second transmitter coil
350 Second receiver coil
410 Liquid jet
412 Interaction region
416 Electron beam
418 X-ray radiation
452*b* Shield arrangement
452*c* Shield arrangement
454 Opening
556 Step of generating liquid jet
558 Step of monitoring quality measure
560 Step of identifying malperformance
562 Step of entering safe mode
608 Liquid jet generator
610 Filter
612 Filter exchange tool
620 Pump
630 Three-way valve
638 Nozzle
640 Filter by-pass path
645 Filter

The invention claimed is:

1. A method for protecting an X-ray source comprising:

a liquid jet generator configured to form a liquid jet moving along a flow axis;

an electron source configured to provide an electron beam interacting with the liquid jet to generate X-ray radiation;

a monitoring arrangement configured to monitor, directly or indirectly, a quality measure indicating a performance of the liquid jet;

wherein the quality measure comprises at least one of
- a shape of the liquid jet;
- a width of the liquid jet;
- a speed of the liquid jet along the flow axis;
- a pressure within the liquid jet generator; and
- a movement of the liquid jet perpendicular to the flow axis;

a processing unit operatively connected to the liquid jet generator, the electron source, and the monitoring arrangement;

wherein the method comprises, by means of the processing unit:

generating the liquid jet;

monitoring the quality measure;

identifying a malperformance of the liquid jet if the quality measure exceeds a quality measure threshold; and if said malperformance is identified, causing the X-ray source to enter a safe mode for protecting the X-ray source.

2. The method according to claim 1, further comprising establishing a nominal trend for the quality measure, and wherein the step of identifying the malperformance comprises detecting a deviation in the quality measure from the nominal trend.

3. The method according to claim 2, wherein the malperformance is identified if the deviation exceeds two standard deviations of the nominal trend.

4. The method according to claim 1, wherein entering the safe mode comprises at least one of:

reducing a speed of the liquid jet along the flow axis;

reducing a power output of the electron source;

terminating generation of the liquid jet;

shielding at least part of the X-ray source from contamination created by the malperformance of the liquid jet; and changing a filter of the liquid jet generator.

5. An X-ray source comprising:

a liquid jet generator configured to form a liquid jet moving along a flow axis;

an electron source configured to provide an electron beam interacting with the liquid jet to generate X-ray radiation;

a monitoring arrangement configured to monitor, directly or indirectly, a quality measure indicating a performance of the liquid jet;

said quality measure comprising at least one of a shape of the liquid jet;

a width of the liquid jet;

a speed of the liquid jet along the flow axis;

a pressure within the liquid jet generator; and a movement of the liquid jet perpendicular to the flow axis; and a processing unit configured to identify a malperformance of the liquid jet if the quality measure exceeds a quality measure threshold;

wherein the X-ray source is configured to enter a safe mode for protecting the X-ray source if said malperformance is identified.

6. The X-ray source according to claim 5, wherein the monitoring arrangement comprises an acoustic sensor configured to detect acoustic emissions created by the liquid jet, and/or the generation of the liquid jet.

7. The X-ray source according to claim 5, wherein the monitoring arrangement comprises an accelerometer configured to detect vibrations created by the liquid jet, and/or by the generation of the liquid jet.

8. The X-ray source according to claim 5, wherein the monitoring arrangement comprises an optic sensor.

9. The X-ray source according to claim 5, wherein the monitoring arrangement comprises an electron detector configured to receive at least part of the electron beam passing the liquid jet.

10. The X-ray source according to claim 5, wherein the monitoring arrangement comprises an X-ray detector configured to detect X-rays generated by an interaction between the electron beam and the liquid jet.

11. The X-ray source according to claim 5, wherein the monitoring arrangement comprises an inductive coil arrangement comprising a transmitter coil and a receiver coil configured to utilize the liquid jet as an inductive coupling between the transmitter coil and the receiver coil, wherein the transmitter coil is configured to pass a current and wherein the receiver coil is configured to receive an induced current.

12. The X-ray source according to claim 5, further comprising a shield arrangement, and wherein the processing unit is configured to, when the X-ray source is in the safe mode, position the shield arrangement such that at least part of the X-ray source is shielded from contamination created by the malperformance of the liquid jet.

13. The X-ray source according to claim 5, further comprising a filter exchange tool, and wherein the processing unit is configured to, when the X-ray source is in the safe mode, operate the filter exchange tool in order to change a filter of the liquid jet generator.

14. The X-ray source according to claim 5, wherein the X-ray source is configured to enter a safe mode by at least one of:

reducing a speed of the liquid jet along the flow axis;

reducing a power output of the electron source;

terminating generation of the liquid jet;

shielding at least part of the X-ray source from contamination created by the malperformance of the liquid jet; and changing a filter of the liquid jet generator.

* * * * *